US008141505B2

(12) United States Patent
Hall et al.

(10) Patent No.: US 8,141,505 B2
(45) Date of Patent: Mar. 27, 2012

(54) YARN COLOR PLACEMENT SYSTEM

(75) Inventors: Wilton Hall, Ringgold, GA (US); Kendall Johnston, Dalton, GA (US)

(73) Assignee: Card-Monroe Corp., Chattanooga, TN (US)

( * ) Notice: Subject to any disclaimer, the term of this patent is extended or adjusted under 35 U.S.C. 154(b) by 985 days.

(21) Appl. No.: 12/122,004

(22) Filed: May 16, 2008

(65) Prior Publication Data

US 2009/0205547 A1 Aug. 20, 2009

Related U.S. Application Data

(60) Provisional application No. 61/029,105, filed on Feb. 15, 2008.

(51) Int. Cl.
*D05C 15/30* (2006.01)

(52) U.S. Cl. ..... 112/80.41; 112/80.23

(58) Field of Classification Search ..... 112/80.01, 112/80.23, 80.3–80.32, 80.4, 80.41, 470.01
See application file for complete search history.

(56) References Cited

U.S. PATENT DOCUMENTS

| | | | |
|---|---|---|---|
| 2,990,792 | A | 7/1961 | Nowicki et al. |
| 3,375,797 | A | 4/1968 | Gaines |
| 3,485,195 | A | 12/1969 | Torrence |
| 3,618,542 | A | 11/1971 | Zocher |
| 3,709,173 | A | 1/1973 | Greene |
| 3,757,709 | A | 9/1973 | Cobble |
| 3,835,797 | A | 9/1974 | Franks et al. |
| 3,847,098 | A | 11/1974 | Hammel, Jr. |
| 3,919,953 | A | 11/1975 | Card et al. |
| 3,943,865 | A | 3/1976 | Short et al. |
| 4,103,629 | A | 8/1978 | Card |
| 4,106,416 | A | 8/1978 | Blackstone, Jr. et al. |
| 4,134,348 | A | 1/1979 | Scott |
| 4,138,956 | A | 2/1979 | Parsons |
| 4,155,319 | A | 5/1979 | Short |
| 4,170,949 | A | 10/1979 | Lund |
| 4,185,569 | A | 1/1980 | Inman |
| 4,193,358 | A | 3/1980 | Woodcock |
| 4,195,580 | A | 4/1980 | Hurst |

(Continued)

FOREIGN PATENT DOCUMENTS

EP 1474354 B1 7/2010

(Continued)

OTHER PUBLICATIONS

Super Graphics Product Brochure, Tuftco Corp., Tuftco's Computer Design System, Chattanooga, TN.

(Continued)

*Primary Examiner* — Nathan Durham
(74) *Attorney, Agent, or Firm* — Womble Carlyle Sandridge & Rice LLP

(57) ABSTRACT

A yarn color placement system for a tufting machine including a series of different color yarns being fed to the needles of the tufting machine by yarn feed mechanisms. A backing material is fed through the tufting machine at an increased stitch rate as the needles are shifted according to the programmed pattern steps. A series of level cut loop loopers or hooks engage and pick loops of yarns from the needles, with the clips of the level cut loop loopers or hooks being selectively actuated to form cut pile tufts, while the remaining loops of yarns can be back-robbed so as to be hidden from view in the finished patterned tufted article.

19 Claims, 8 Drawing Sheets

U.S. PATENT DOCUMENTS 4,313,388 A 2/1982 Biggs et al.
4,353,317 A 10/1982 Crumbliss
4,366,761 A 1/1983 Card
4,369,720 A 1/1983 Beasley
4,393,793 A 7/1983 Beasley
4,397,249 A 8/1983 Slattery
4,419,944 A 12/1983 Passons et al.
4,440,102 A 4/1984 Card et al.
4,466,366 A 8/1984 Hirotsu
4,522,132 A 6/1985 Slattery
4,549,496 A 10/1985 Kile
4,557,208 A 12/1985 Ingram et al.
4,574,716 A 3/1986 Czelusniak, Jr.
4,619,212 A 10/1986 Card et al.
4,630,558 A 12/1986 Card et al.
4,637,329 A 1/1987 Czelusniak, Jr.
4,667,611 A 5/1987 Yamamoto et al.
4,688,497 A 8/1987 Card et al.
4,815,403 A 3/1989 Card et al.
4,836,118 A 6/1989 Card et al.
4,841,886 A 6/1989 Watkins
4,849,270 A 7/1989 Evans et al.
4,856,441 A 8/1989 Kurata
4,860,674 A 8/1989 Slattery
4,864,946 A 9/1989 Watkins
4,867,080 A 9/1989 Taylor et al.
4,903,624 A 2/1990 Card et al.
4,903,625 A 2/1990 Card et al.
4,981,091 A 1/1991 Taylor et al.
4,991,523 A 2/1991 Ingram
5,005,498 A 4/1991 Taylor et al.
5,058,518 A 10/1991 Card et al.
5,080,028 A 1/1992 Ingram
5,094,178 A 3/1992 Watkins
5,158,027 A 10/1992 Ingram
5,165,352 A 11/1992 Ingram
5,182,997 A 2/1993 Bardsley
5,224,434 A 7/1993 Card et al.
5,383,415 A 1/1995 Padgett, III
5,458,075 A 10/1995 Tice et al.
5,461,996 A 10/1995 Kaju
5,501,250 A 3/1996 Edwards et al.
5,526,760 A 6/1996 Ok
5,544,605 A 8/1996 Frost
5,549,064 A 8/1996 Padgett, III
5,566,630 A 10/1996 Burgess et al.
5,575,228 A 11/1996 Padgett, III et al.
5,588,383 A 12/1996 Davis et al.
5,622,126 A 4/1997 Card et al.
5,662,054 A 9/1997 Bardsley
5,738,030 A 4/1998 Ok
5,743,201 A 4/1998 Card et al.
5,794,551 A 8/1998 Morrison et al.
5,806,446 A 9/1998 Morrison et al.
5,899,152 A 5/1999 Bardsley et al.
5,954,003 A 9/1999 Beyer et al.
5,983,815 A 11/1999 Card
6,009,818 A 1/2000 Card et al.
6,155,187 A 12/2000 Bennett et al.
6,196,145 B1 3/2001 Burgess
6,202,580 B1 3/2001 Samilo
6,228,460 B1 5/2001 Hamilton et al.
6,244,203 B1 6/2001 Morgante et al.
6,263,811 B1 7/2001 Crossley
6,273,011 B1 8/2001 Amos
6,283,053 B1 9/2001 Morgante et al.
6,293,211 B1 9/2001 Samilo
6,401,639 B1 6/2002 Samilo
6,439,141 B2 8/2002 Morgante et al.
6,446,566 B1 9/2002 Bennett et al.
6,502,521 B2 1/2003 Morgante et al.
6,508,185 B1 1/2003 Morgante et al.
6,516,734 B1 2/2003 Morgante et al.
6,550,407 B1 4/2003 Frost et al.
6,758,154 B2 7/2004 Johnston
6,807,917 B1 10/2004 Christman et al.
6,823,900 B2 11/2004 Wildeman et al.
6,834,601 B2 12/2004 Card et al.
6,834,602 B1 12/2004 Hall
6,877,447 B2 4/2005 Frost et al.
6,877,449 B2 4/2005 Morgante et al.
6,945,184 B2 9/2005 Frost et al.
6,971,326 B1 12/2005 Clarke et al.
7,033,661 B2 4/2006 Whitten et al.
7,083,841 B2 8/2006 Oakey et al.
7,089,874 B2 8/2006 Morgante et al.
7,096,806 B2 8/2006 Card et al.
7,130,711 B2 10/2006 Dabrowa et al.
7,216,598 B1 5/2007 Christman, Jr.
7,243,513 B2 7/2007 Kohlman
7,296,524 B2 11/2007 Beverly
7,333,877 B2 2/2008 Dabrowa et al.
7,347,151 B1 3/2008 Johnston et al.
RE40,194 E 4/2008 Slattery
7,350,443 B2 4/2008 Oakey et al.
7,356,453 B2 4/2008 Gould
7,426,895 B2 9/2008 Smith et al.
7,431,974 B2 10/2008 Lovelady et al.
7,490,566 B2 2/2009 Hall
7,490,569 B2 2/2009 Whitten et al.
7,634,326 B2 12/2009 Christman, Jr. et al.
7,682,686 B2 3/2010 Curro et al.
7,717,051 B1 5/2010 Hall et al.
7,814,850 B2 10/2010 Beardon
2002/0037388 A1 3/2002 Morgante et al.
2003/0164130 A1 9/2003 Morgante et al.
2004/0025767 A1 2/2004 Card et al.
2004/0187268 A1 9/2004 Johnston
2004/0253409 A1 12/2004 Whitten et al.
2005/0056197 A1 3/2005 Card et al.
2005/0109253 A1* 5/2005 Johnston ..... 112/80.44
2005/0204975 A1 9/2005 Card et al.
2006/0272564 A1 12/2006 Card et al.
2007/0272137 A1 11/2007 Christman et al.
2008/0134949 A1 6/2008 Bearden

FOREIGN PATENT DOCUMENTS

EP 2 100 994 B1 6/2011
GB 853943 1/1957
GB 859761 6/1959
GB 920023 2/1960
GB 853 943 11/1960
GB 859 761 1/1961
GB 920 023 3/1963
GB 1 039 857 8/1966
GB 1039857 8/1966
GB 2050447 1/1980
GB 2 050 447 1/1981
GB 2115025 A 9/1983
GB 2 246 371 1/1992
GB 2446371 A 1/1992
GB 2319786 A 6/1998
WO WO8400388 2/1984
WO WO9428225 5/1994
WO WO 96/12843 5/1996
WO WO9612843 5/1996
WO WO0159195 8/2001
WO WO2004057084 7/2004

OTHER PUBLICATIONS

CAM with Encore DMC, Operator's Manual, Version 3.6, Tuftco Corporation, Copyright 1995, Chattanooga, TN.
CMC's Yarn Feed/Shift Compensation System Product Brochure, Card-Monroe Corp., Chattanooga, TN.
Command Performance 2000 Instruction Manual, Version 3.12, CMC #801107-01, Card-Monroe Corp., Copyright 1985-1994, Chattanooga, TN.
Tuft Program, Version 1.20, Nov. 1993, NedGraphics BV.
CMC Yarntronics Brochure, http://www.cardmonroe.com/Products/Yarntronics/yarnt.htm, printed Feb. 21, 2002.
MTInnovation Patterning Systems, Modern Techniques, Inc., Ringgold, GA.
Zieseniss Tufting Machine Operational Manual.
Automation Comes to Paris, Carpet & Rug, Inc., 1987.
Encore DMC Operator's Manual, Version 3.6, Tuftco Corporation, Chattanooga, TN.

Control System for Tufting Machines, Tuftco Corp., Chattanooga, TN.
Moving Toward Total Automation, Carpet & Rug Industry, Dec. 1990.
Carpet Design, Technology Are on a Roll, Kathryn Sellers, Carpet & Rug Institute, © 2001, Textile World, vol. 151, No. 3.
NedGraphics, Aug. 26, 1994, Carpet & Floor Coverings Review.
Simple or sophisticated? Computers: CAD, Sep. 11, 1992, Carpet & FloorCoverings Review, pp. 32-34.
Extended European Search Report dated Aug. 7, 2009, European Patent Application No. 09 152 848 .9 (Pub No. 2 100 994).
European Official Communication dated Mar. 25, 2010, European Patent Application No. 09 152 848 .9 (Pub No. 2 100 994).
European Notice of Intention to Grant a European Patent dated Dec. 13, 2010, European Patent Application No. 09 152 848 .9 (Pub No. 2 100 994).
Response submitted Sep. 30, 2010, to the Communication dated Mar. 25, 2010, European Patent Application No. 09 152 848 9 (Pub No. 2 100 994).
Partial search report for related application, European Search Report, application No. EP 09 15 2848.

* cited by examiner

THREE COLORS

FOUR COLORS

FIVE COLORS

SIX COLORS

YARN COLOR PLACEMENT SYSTEM

RELATED APPLICATION

This application claims the benefit of U.S. Provisional Application No. 61/029,105, filed Feb. 15, 2008, which is hereby incorporated by reference in its entirety.

FIELD OF THE INVENTION

The present invention generally relates to tufting machines, and in particular, to a system for controlling the feeding and placement of yarns of different colors within a backing material passing through a tufting machine to enable formation of free-flowing patterns within a tufted article.

BACKGROUND OF THE INVENTION

In the tufting of carpets and other, similar articles, there is considerable emphasis placed upon development of new, more eye-catching patterns in order to try to keep up with changing consumer tastes and increased competition in the marketplace. In particular, there has been emphasis over the years on the formation of carpets that replicate the look and feel of fabrics formed on a loom. With the introduction of computer controls for tufting machines such as disclosed in the U.S. Pat. No. 4,867,080, greater precision and variety in designing and producing tufted pattern carpets, as well as enhanced production speeds, have been possible. In addition, computerized design centers have been developed to help designers design and create wider varieties of patterns, with requirements such as yarn feeds, pile heights, etc. being automatically calculated and generated by the design center computer.

Additionally, attempts have been made to develop tufting machines in which a variety of different color yarns can be inserted into a backing material to try to create more free-flowing patterns. For example, specialty machines have been developed that include a moving head that carries a single hollow needle in which the ends of the different color yarns are individually fed to the needle for insertion into the backing material at a selected location. Other machines having multiple needles in a more conventional tufting machine configuration and which move the backing material forwardly and rearwardly to place multiple colors in the backing material also have been developed. A problem exists, however, with such specialty tufting machines for individually placing yarns, in that the production rates of such machines generally are restricted as the yarns are placed individually in the backing material by the single needle or as the backing feed direction is changed. As a consequence, such specialized color patterning machines typically are limited to special applications such as formation of patterned rugs or carpets of limited or reduced sizes.

Accordingly, it can be seen that a need exists for a system and method that addresses these and other related and unrelated problems in the art.

SUMMARY OF THE INVENTION

Briefly described, the present invention generally relates to a yarn color placement system for a tufting machine for use in forming patterned tufted articles, such as carpets, including the formation of substantially free-flowing patterns and/or carpets with a woven or loom formed appearance. The tufting machine with the yarn color placement system of the present invention typically will include a tufting machine control system for controlling the operative elements of this tufting machine, and one or more shifting needle bars having a series of needles spaced therealong. A tufting zone is defined along the reciprocating path of the needles through which a backing material is fed at a programmed or prescribed rate of feeding or desired stitch rate. As the backing material is fed through the tufting zone, the needles are reciprocated into and out of the backing material to form loops of yarns therein.

A shift mechanism is provided for shifting the needle bar(s) transversely across the tufting zone, and multiple shift mechanisms typically will be utilized where the tufting machine includes more than one shifting needle bar. The shift mechanism(s) can include one or more cams, servo motor controlled shifters, or other shifters such as a "SmartStep" shift mechanism as manufactured by Card-Monroe Corp., which shift the needle bar in accordance with the designed pattern shift steps. The shift steps for the needle bar(s) will be accomplished in accordance with a cam or shift profile calculated or designed into the pattern when the pattern is created, or in accordance with pre-designed or pre-loaded patterns programmed into the tufting machine controller. The cam or shift profile further can be varied depending on the number of colors to be used in the pattern being formed. For example, for three or four colors, a three or four color cam or cam profile can be utilized for shifting each needle bar.

The yarn color placement system further generally will include a pattern yarn feed mechanism or attachment for controlling the feeding of the yarns to their respective needles in conjunction with the shift profile of the programmed pattern for the tufted article. The pattern yarn feed pattern mechanism can include various roll, scroll, servo-scroll, single end, or double end yarn feed attachments, such as, for example, a Yarntronics™ or Infinity™ or Infinity IIE™ yarn feed attachment as manufactured by Card-Monroe Corp. Other types of yarn feed control mechanisms also can be used to control the feeding of the yarns to their selected needles according to the programmed pattern instructions so as to pull low or backrob from the backing material those yarns to be hidden in the pattern fields being sewn at that time. The system control of the tufting machine further typically will control the operative functions of the tufting machine, including the cooperative operation of the shift mechanism(s) and yarn feed mechanism(s) according to the programmed repeating pattern instructions.

Additionally, a looper or hook assembly including gauge parts such as cut-pile hooks, loop pile loopers, level cut loopers or hooks and/or various combinations of such gauge parts generally will be provided below the tufting zone in positions adapted to engage the needles as the needles penetrate the backing material so as to pick and/or pull loops of yarns therefrom. In one embodiment, a series of the level cut loop loopers are individually controlled by the system control of the tufting machine during each stitch, based on the pattern stitch being formed and shift profile step therefore, so as to be actuated or fired selectively for each stitch according to whether the loops of yarns being formed thereby are to be pulled back or backrobbed, and thus hidden upon the formation of each stitch in the pattern, kept as loop pile tufts, or retained on the level cut loop looper to form a cut pile tuft.

The yarn color placement system according to the principles of the present invention further generally will be operated at increased or denser effective process stitch rates than conventional tufting processes. Typically, the operative or effective stitch rate run by the yarn placement system will be approximately equivalent to a desired or prescribed fabric stitch rate or number of stitches per inch for the patterned tufted article being formed that is based upon the rate at which the backing material is fed and the gauge of the tufting machine, multiplied by the number of colors being run in the programmed pattern. As a consequence, as the needle bar(s) is shifted during the formation of the pattern stitches, for each color to be taken out or back-robbed and thus hidden in the finished patterned article, the increased number of stitches per inch will provide sufficient enhanced density between the high and low tufts of the finished patterned tufted article to avoid a missing color or gap being shown or otherwise appearing in the patterned tufted article.

Various objects, features and advantages of the present invention will become apparent to those skilled in the art upon a review of the following detailed description when taken in conjunction with the accompanying drawings.

DETAILED DESCRIPTION OF THE INVENTION

Figure 1:
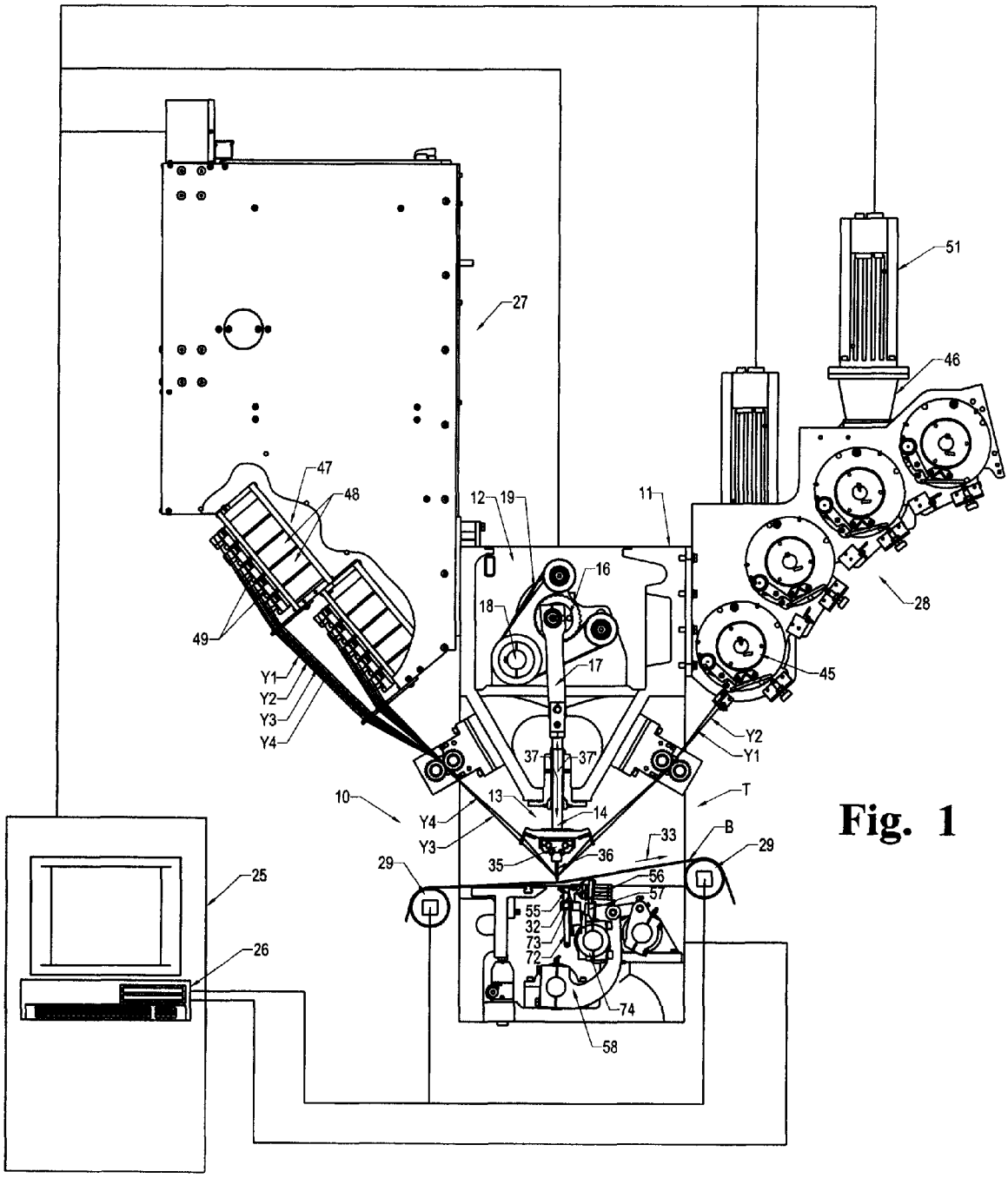
FIG. 1 is a side elevational view of a tufting machine incorporating the yarn color placement system of the present invention.

Referring now to the drawings in which like numerals indicate like parts throughout the several views, in accordance with one example embodiment of the yarn color placement system of the present invention, as generally illustrated in FIGS. 1-5, a tufting machine 10 is provided for controlling placement of yarns Y1-Y4, etc., of different colors at desired locations in a backing material B to form a tufted article having a variety of varying or free-flowing colored pattern effects therein. While four yarns/colors are indicated, it will be understood that more or fewer different color yarns (i.e., two color, three color, five color, six colors, etc., as illustrated in FIGS. 6A-6D) also can be utilized in the yarn color placement system of the present invention.

As generally illustrated in FIG. 1, the tufting machine 10 generally includes a frame 11, including a head portion 12 housing a needle bar drive mechanism 13 and defining a tufting zone T. The needle bar drive mechanism 13 (FIGS. 1, 3 and 4) typically includes a series of push rods 14 connected to a gear box drive 16 or similar mechanism, by connector rods 17. The gear box drive 16 in turn is connected to and driven off a main drive shaft 18 (FIGS. 1 and 4) for the tufting machine by one or more drive belts or drive chains 19, with the main drive shaft 18 itself being driven by a motor, such as a servo motor. Alternatively, the push rods 14 of the needle bar drive mechanism 13 can be directly connected via connector rods 17 to the main drive shaft 18 so as to be driven directly off the main drive shaft to control operation of the main drive shaft motor (not shown).

An encoder additionally can be provided for monitoring the rotation of the main drive shaft and reporting the position of the main drive shaft to a tufting machine control system 25 (FIG. 1). The tufting machine control system 25 generally will comprise a tufting machine control such as a "Command-Performance™" tufting machine control system as manufactured by Card-Monroe Corp. The control system also typically includes a computer/processor or controller 26 that can be programmed with various pattern information and which monitors and controls the operative elements of the tufting machine 10, such as the needle bar drive mechanism 13, yarn feed attachments 27/28, backing feed rolls 29, the main drive shaft 18, a needle bar shift mechanism 31 (FIGS. 3 and 4) and a looper or hook assembly 32 mounted beneath the tufting zone T of the tufting machine, as discussed more fully below. The tufting machine control system 25 (FIG. 1) further can receive and execute or store pattern information directly from a design center (not shown) that can be separate and apart from the tufting machine control system, or which can be included as part of the tufting machine control system. In response to such programmed pattern instructions, the tufting machine control system 25 will control the operative elements of the tufting machine 10 in order to form the desired tufted patterns in the backing material B as the backing material is passed through the tufting zone T in the direction of arrow 33 by the backing feed rolls 29.

As indicated in FIGS. 1-5, the needle bar drive mechanism 13 of the tufting machine 10 also will include one or more shiftable needle bars 35 attached to and driven by the push rods 14 and carrying a series of needles 36 arranged in in-line or offset rows spaced transversely along the length of the needle bar and across the tufting zone of the tufting machine. While only a single shifting needle bar 35, with an inline row of needles 36 arranged therealong is shown in the figures, it will be understood by those skilled in the art that additional arrangements of dual shifting needle bars having spaced rows of needles 36 arranged in-line or in a staggered or offset configuration also can be utilized in the tufting machine 10 incorporating the yarn control placement system according to the present invention. The needles will be arranged at a desired spacing in the warp direction based on the gauge of the tufting machine, i.e., ⅛" for an eighth gauge machine, 1/10" for a tenth gauge, 5/32" for a five-thirty seconds gauge, etc.

During operation of the needle bar drive mechanism, the needles are reciprocated, as indicated by arrows 37 and 37' (FIG. 2), into and out of the backing material B, carrying the yarns Y1-Y4 so as to insert or place loops of yarn in the backing material for forming loop pile and cut pile tufts 38 in the backing material. Additionally, as illustrated in the embodiments shown in FIGS. 3 and 4, shift mechanism 31 generally will be linked to the needle bar 35 for shifting the needle bar in the direction of arrows 41 and 41', transversely across the tufting zone according to programmed pattern instructions. The shift mechanism 31 can include a Smart Step™ type shifter as manufactured by Card-Monroe Corp., or alternatively can include various other types of shift mechanisms including servo motor or hydraulically controlled shifters, and/or pattern cam shifters as are conventionally used.

As part of the pattern information/instructions programmed into the tufting machine control system 25 (FIG. 1), there typically will be a cam profile or shift profile of the shift steps calculated for the pattern to be tufted when the pattern is created, such as at a design center, for controlling the shifting or stepping of the needle bar(s) back and forth across the warp direction of the backing material as necessary to form the desired pattern. The pattern shift steps or cam profile also can be varied depending on the number of colors used in the pattern being run. Still further, the initial shift steps can be repeated at the end of a pattern cycle, i.e., the first and last step of each pattern shift profile run can be the same, and will be designed to facilitate the placement of the high tufts of each color at desired locations or points in the pattern fields.

Figure 6A:
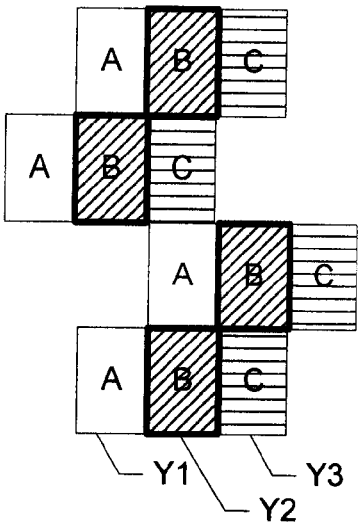
FIGS. 6A-6D are schematic illustrations of example shift/step patterns for tufting patterns having different numbers of colors using the method of the present invention.
Figure 6B:
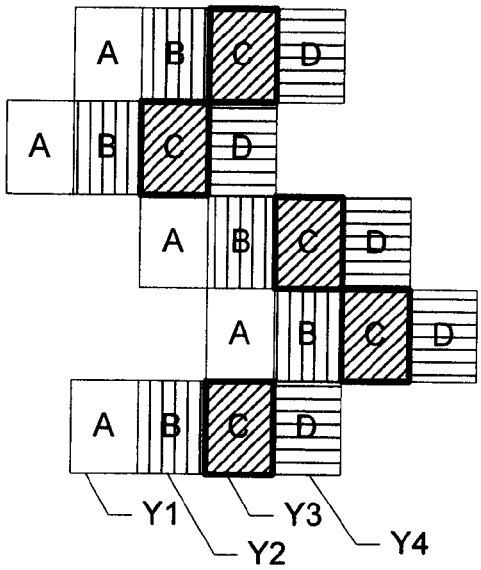
Figure 6C:
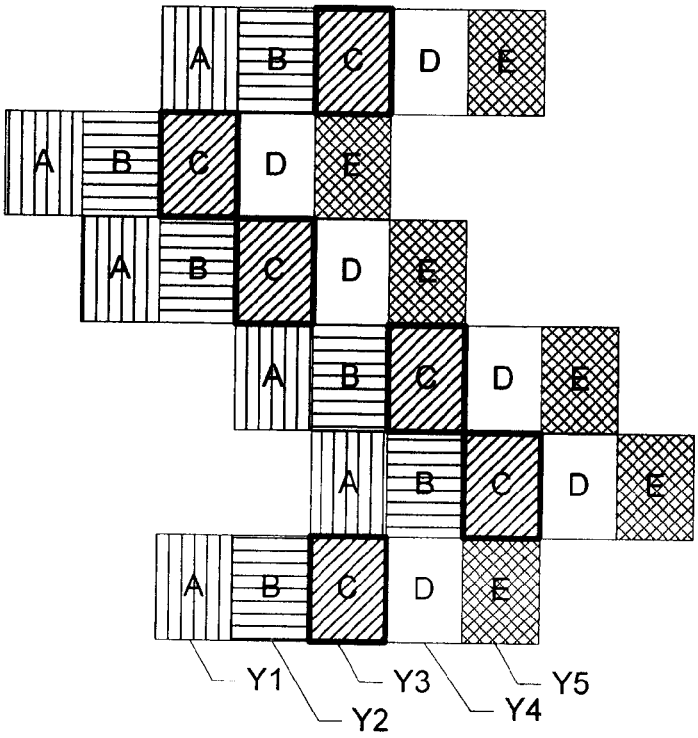
Figure 6D:
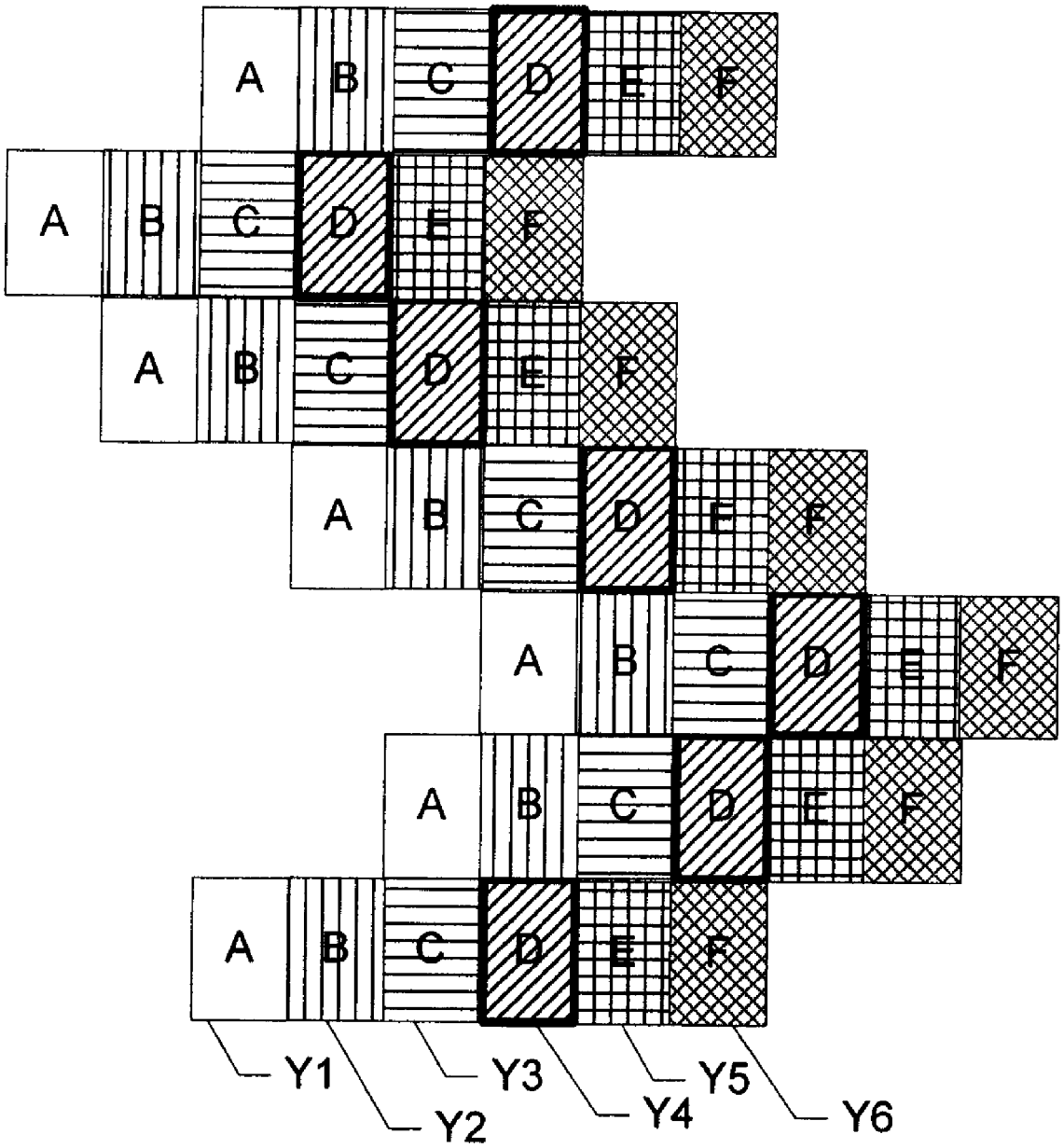

FIGS. 6A-6D illustrate various shift or stepping patterns for the needle bar, reflecting the shifting of the needle bar where three, four, five or six different color yarns are utilized in the pattern, and illustrate various example single and double step or jump segments followed to avoid oversewing prior sewn tufts. For example, for running a stepping pattern utilizing three different colors of yarns, as indicated in FIG. 6A, an initial step or shift can be made to the right, which would then be followed by a double gauge shift or jump, ending with a single gauge shift. Similarly, for four, five and/or six colors, shown in FIGS. 6B-6D, after an initial shift to the right of either a single or double gauge jump, the pattern then shifts back to the left using single and double gauge jumps or shifts in order to avoid sewing over or over-tufting previously sewn tufts. Additionally, while the initial shift or jump is shown as going to the right in FIGS. 6A-6B, it is also possible to start the shift steps to the left. Still further, as the needle bar is shifted, the backing material also is generally fed through the tufting machine at an increased or denser stitch rate to achieve a denser pattern or fill-in of the selected colors for the particular field of the pattern.

In some conventional tufting systems, the fabric stitch rate for tufting patterns run thereby generally has been matched to the gauge of the tufting machine, which generally is equivalent to the number of needles per inch in the warp direction (i.e., for eighth gauge there are 8 needles per inch at ⅛" spacings, 10 needles per inch at 1/10" spacings for tenth gauge, etc.), which in turn generally equals the number of stitches per inch in the weft direction in which the tuft rows are formed. Thus, for a tenth gauge tufting machine, for example, the desired or prescribed fabric stitch rate typically will be approximately ten stitches per inch, while for an eighth gauge machine, the stitch rate will be approximately eight stitches per inch. In the present invention, the operative or effective process stitch rate run by the yarn color placement system will be substantially higher or faster than typical desired fabric stitch rates, thus providing enhanced or increased density of the tufts formed in the backing material. Typically, with the yarn color placement system of the invention, this enhanced effective process stitch rate will be approximately equivalent to the desired fabric stitch rate (that generally is based on the gauge of the tufting machine) multiplied by the number of different colors being run in the pattern.

Thus, with yarn color placement system of the present invention, for a tenth gauge machine generally run using a desired fabric stitch rate of approximately ten stitches per inch, if there are three colors in the pattern, the operative or effective process stitch rate run by the yarn color placement system will be determined by the desired stitch rate (10 stitches per inch), multiplied by the number of colors (3), for an effective process stitch rate of approximately thirty stitches per inch, for four colors, the operative or effective stitch rate for a four color pattern can be approximately forty stitches per inch, fifty stitches per inch for five colors, etc. Similarly, for an eighth gauge machine, with a desired stitch rate of 8 stitches per inch and 2-6 colors being run, the effective stitch rate can be between about 16 to about 48 stitches per inch depending on the number of colors run, while for a sixteenth gauge machine with 2-6 colors, the effective process stitch rate can be between about 52 to about 96 stitches per inch.

Figure 3:
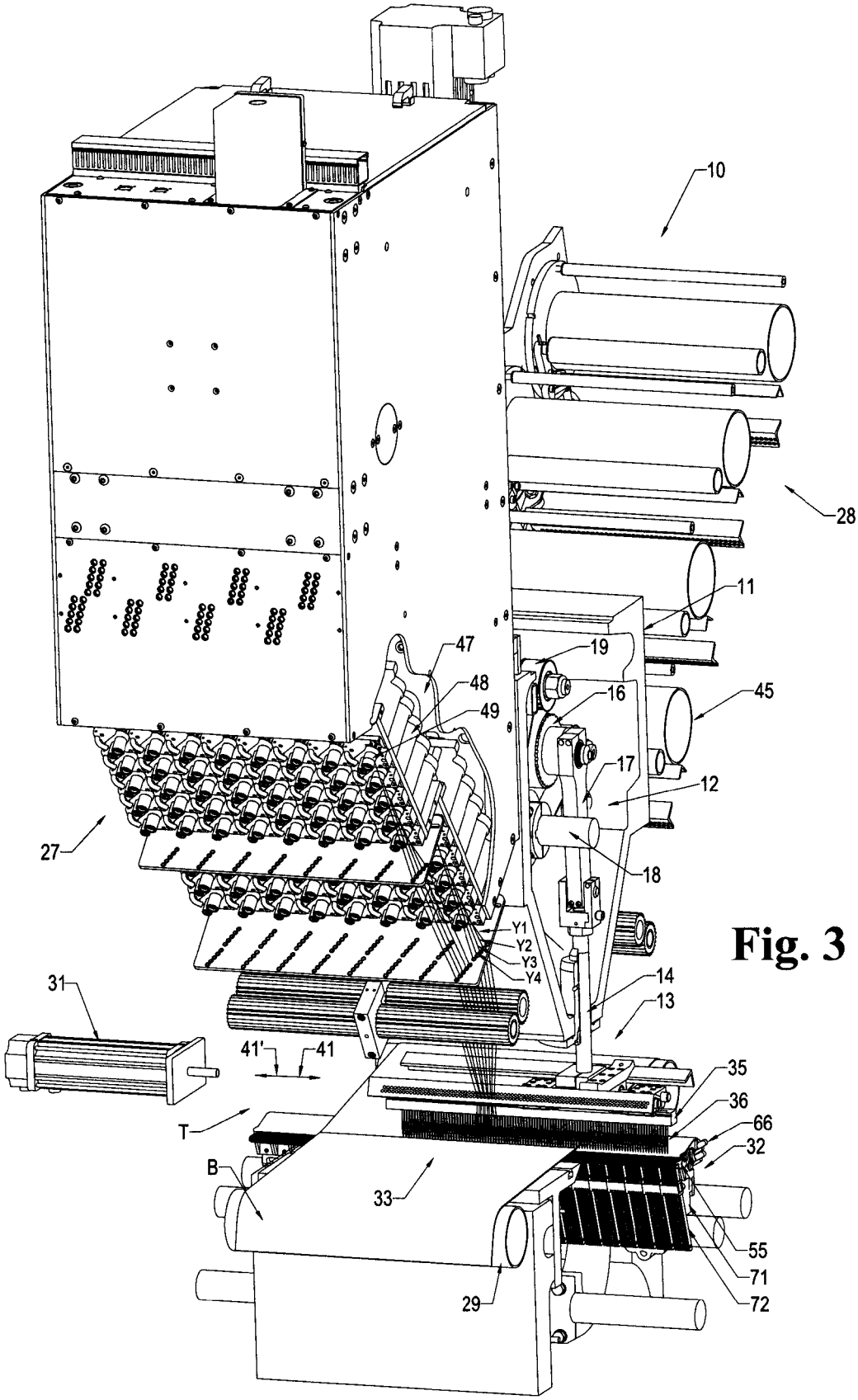
FIG. 3 is a perspective illustration of the yarn color placement system of FIG. 1.
Figure 4:
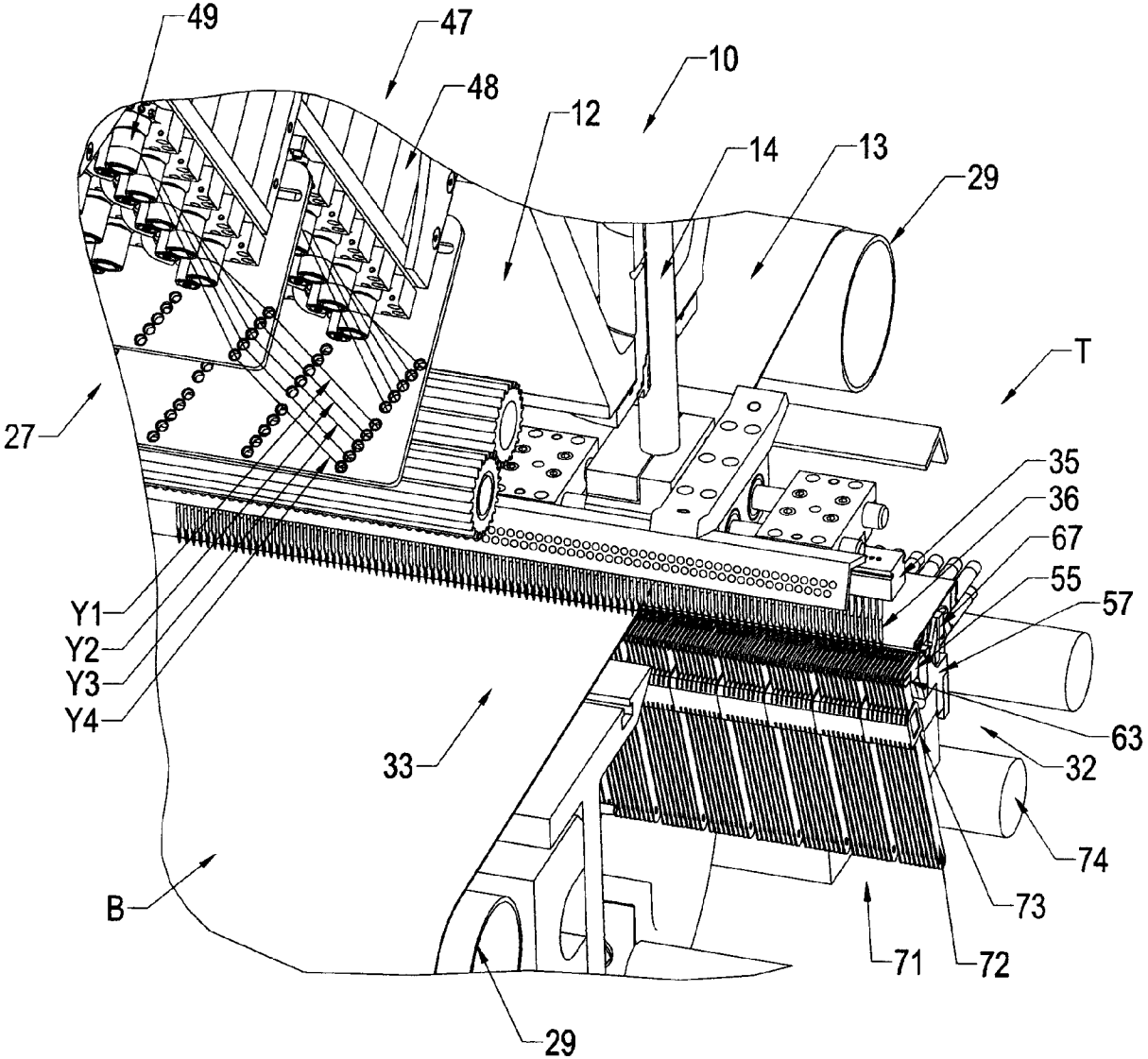
FIG. 4 is a perspective illustration, with parts broken away, illustrating the operation of the level cut loop loopers and shifting of the needle bars in the yarn color placement system of FIG. 1.

As additionally indicated in FIGS. 1, 3 and 4, one or more yarn feed attachments 27 and/or 28 also generally can be mounted to the frame 11 of the tufting machine 10 for controlling the feeding of the different color yarns Y1-Y4, etc. to each of the needles during operation of the tufting machine, including pulling back or back-robbing yarns, to form high tufts of yarns, and low tufts of yarns that are to be hidden in particular color fields of the pattern formed in the backing material. There are a variety of yarn feed attachments that are utilized in the yarn color placement system of the present invention for controlling the feeding of the different color yarns Y1-Y4, etc. to various ones of the needles 36. For example, the pattern yarn feed attachments or mechanisms can include conventional yarn feed/drive mechanisms such as roll or scroll pattern attachments, as indicated at 28 in FIGS. 1 and 3, having a series of rolls 45 extending at least partially along the tufting machine and driven by motors 46 under direction of the system control 25 (FIG. 1), for controlling the feeding of all of the yarns across the tufting machine to form pattern repeats across the width of the backing material, and including Quick Thread™, Enhanced Graphics™, and/or Multi Pile Height Scroll yarn feed controls/attachments as manufactured by Card-Monroe Corp. Alternatively, other types of pattern yarn feed attachments can be used, as indicated at 27, which have multiple yarn feed drives 47 (FIG. 3), each including a motor 48 and feed rolls 49, for controlling the feeding of specific sets of repeats of yarns to selected needles, including the use of individual yarn feed rolls or drives 48 for controlling the feeding of single yarns or pairs of yarns to each of the needles 36, such as single end/servo-scroll attachments, and/or the Infinity™ and Infinity IIE™ systems as manufactured by Card-Monroe Corp.

For example, U.S. Pat. Nos. 6,009,818; 5,983,815; and 7,096,806 disclose pattern yarn feed mechanisms or attachments for controlling feeding or distribution of yarns to the needles of a tufting machine. U.S. Pat. No. 5,979,344 further discloses a precision drive system for driving various operative elements of the tufting machine. All of these systems can be utilized with the present invention and are incorporated herein by reference in their entireties. Additionally, while in FIG. 1 a roll or scroll-type pattern attachment is shown at 28 as being used in conjunction with a single or double end type yarn feed mechanism 27, it also will be understood by those skilled in the art all of the pattern yarn feed mechanisms 27/28 utilized to control the yarn feed in the yarn color placement system of the present invention can include only single or double end yarn feed controls, or only scroll, roll, or similar attachments, and can be mounted along one or both sides of the tufting machine.

As indicated in FIGS. 1-4, the backing material B is fed through the tufting zone along a feed or path in the direction of arrow 33 by the backing rolls 29 (FIGS. 1 and 2) by the operation of drive motors 51 that are linked to and controlled by the machine control system 25. The backing material B is engaged by the needles 36 that insert the yarns Y1-Y4 to form the tufts 38 of yarns in the backing material at the effective stitch rate for the pattern being formed by the yarn color placement system of the present invention (i.e., the desired stitch rate, such as 8, 10, 16, etc., stitches per inch, multiplied by the number of colors of the pattern). As the needles penetrate the backing material, they are engaged by the looper/hook assembly 32 so as to form loops of yarns that can be cut to form cut-pile tufts, or can be remain as loops according to each pattern step. The released loops of yarns can be backrobbed or pulled low or out of the backing by the operation of the pattern yarn feed attachment(s) 27/28 as needed to vary the height of the loops of the additional colored yarns that are not to be shown or visually present in the color field of the pattern being sewn at that step.

Figure 2:
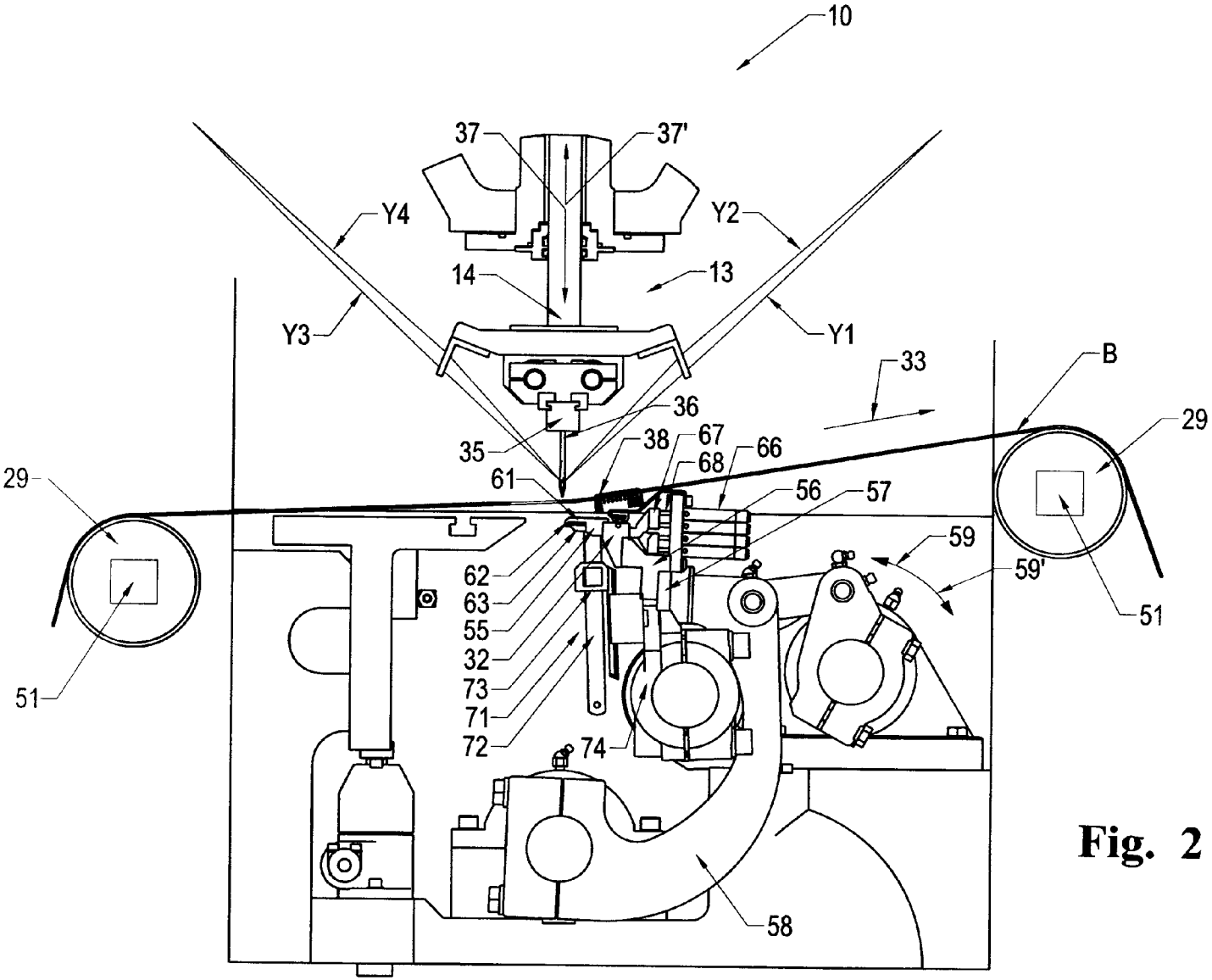
FIG. 2 is a side elevational view of the tufting machine of FIG. 1, illustrating the needles and level cut loopers.

As shown in FIGS. 1 and 2, the looper/hook assembly 32 generally is mounted below the bed and tufting zone T of the tufting machine 10, and includes a series of gauge parts that can comprise loop pile loopers, cut pile hooks, and/or level cut loop loopers. In one example embodiment of the yarn color placement system according to the present invention shown in FIG. 2, the looper/hook assembly 32 generally includes a series of level cut loop loopers 55 mounted on a support block or holder 56 that is attached to a hook or looper bar 57 that is itself mounted on a reciprocating drive arm 58. The drive arm 58 reciprocates the level cut loop loopers 55 toward and away from the needles 36 in the direction of arrows 59 and 59', as the needles penetrate the backing material so that the level cut loop loopers engage the needles to pick and pull the loops of yarns therefrom. It also will be understood by those skilled in the art, however, that while the present invention as disclosed herein is for use with level cut loopers or hooks, it also could be possible to utilize loop pile loopers and/or cut pile hooks, as well as combinations of level cut loop loopers, cut pile hooks and/or loop pile loopers in the yarn placement system of the present invention in order to form the desired patterned articles.

As indicated in FIG. 2, each of the level cut loop loopers 55 generally includes a looper body 61, the rear portion of which is received in the support or hook block 56, and a hooked front or bill portion 62 that extends forwardly therefrom. A series of slots (not shown) generally are formed within the support block 56 adjacent each looper body 61, through which clips 63 are slidably received so as to be moveable from a retracted position rearward of the front portion 62 of each looper 55, to an extended position, projecting adjacent or in contact with the front bill portion 62, as indicated in FIG. 2. In its extended position, each clip prevents a loop of yarn engaged by its associated level cut looper 55 from being captured and held behind the hooked front or bill portion 62 and thereafter being cut. Each of the clips generally includes an elongated body typically formed from metal, plastic, composite or other similar material having a first proximal end that is adapted to extend adjacent the front bill portion of each associated level cut looper, and a rear portion (not shown) that extends through the support block 56.

The clips further each are linked to an associated actuator 66 by a connector or gate 67 which itself is connected to one or more output or drive shafts 68 of its associated actuator(s) 66. The actuators 66 are mounted in spaced, vertically offset rows, along an actuator block and generally can include hydraulic or other similar type cylinders or can include servo motors, solenoids or other similar type mechanisms for driving the clips between their extended and retracted positions.

Each connector or gate 67 further includes an actuator connector portion configured to be connected to an output shaft of an actuator, an extension portion extending forwardly from and at an angle with respect to the actuator connector portion along a direction transverse to the axial direction and a slot portion connected to the extension portion and defining a connector slot extending from the extension portion. The connector slot is configured to engage an associated clip 63, with the connector slot further including laterally spaced side walls defining the slot in which the clip is received. Additionally, each connector slot can be about 0.001 inches-0.003 inches greater in width than the width of the clip that is received therein to enable seating of the clips therein while preventing twisting of the clips during movement thereof, as the lateral side walls generally will prevent substantial lateral movement of the clips relative to their connectors and thus will prevent rotation of the clips about the longitudinal axis of the clips.

Figure 5:
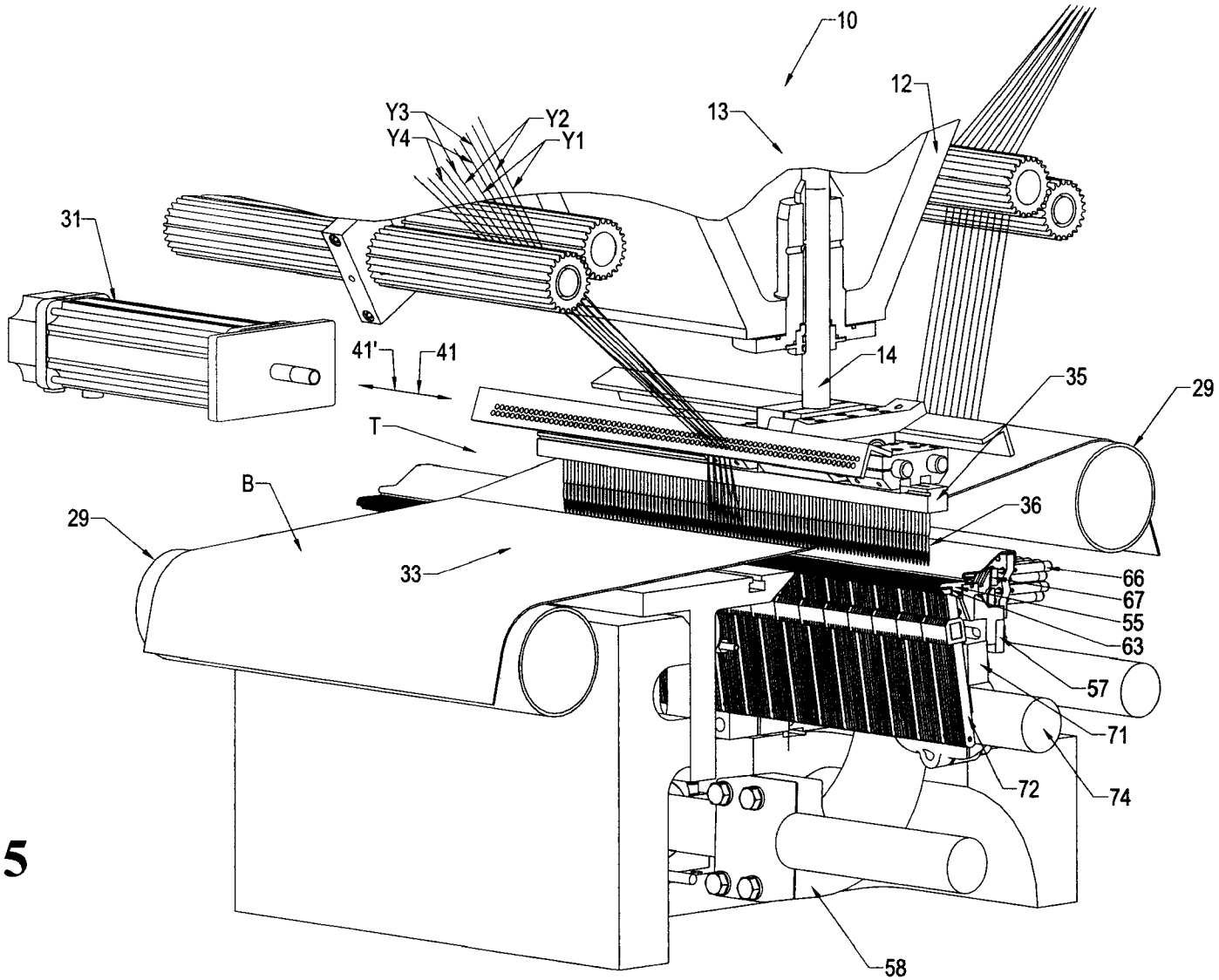
FIG. 5 is a perspective view illustrating a portion of the tufting zone of the tufting machine according to the embodiment of FIG. 1.

As further illustrated in FIGS. 2 and 5, a series of knife assemblies 71 typically are provided adjacent the level cut loopers 55 of the hook or looper/hook assembly 32. The knife assembly 71 generally include a knife or cutting blade 72 mounted within the holder 73 connected to a reciprocating drive mechanism 74. The knives are reciprocated into engagement with the level cut loopers 55 so as to cut any loops of yarns selectively captured thereon in order to form the cut pile tufts 38 in the backing material as the backing material B is passed through the tufting zone in the direction of arrow 33, as indicated in FIG. 2.

Figure 7:
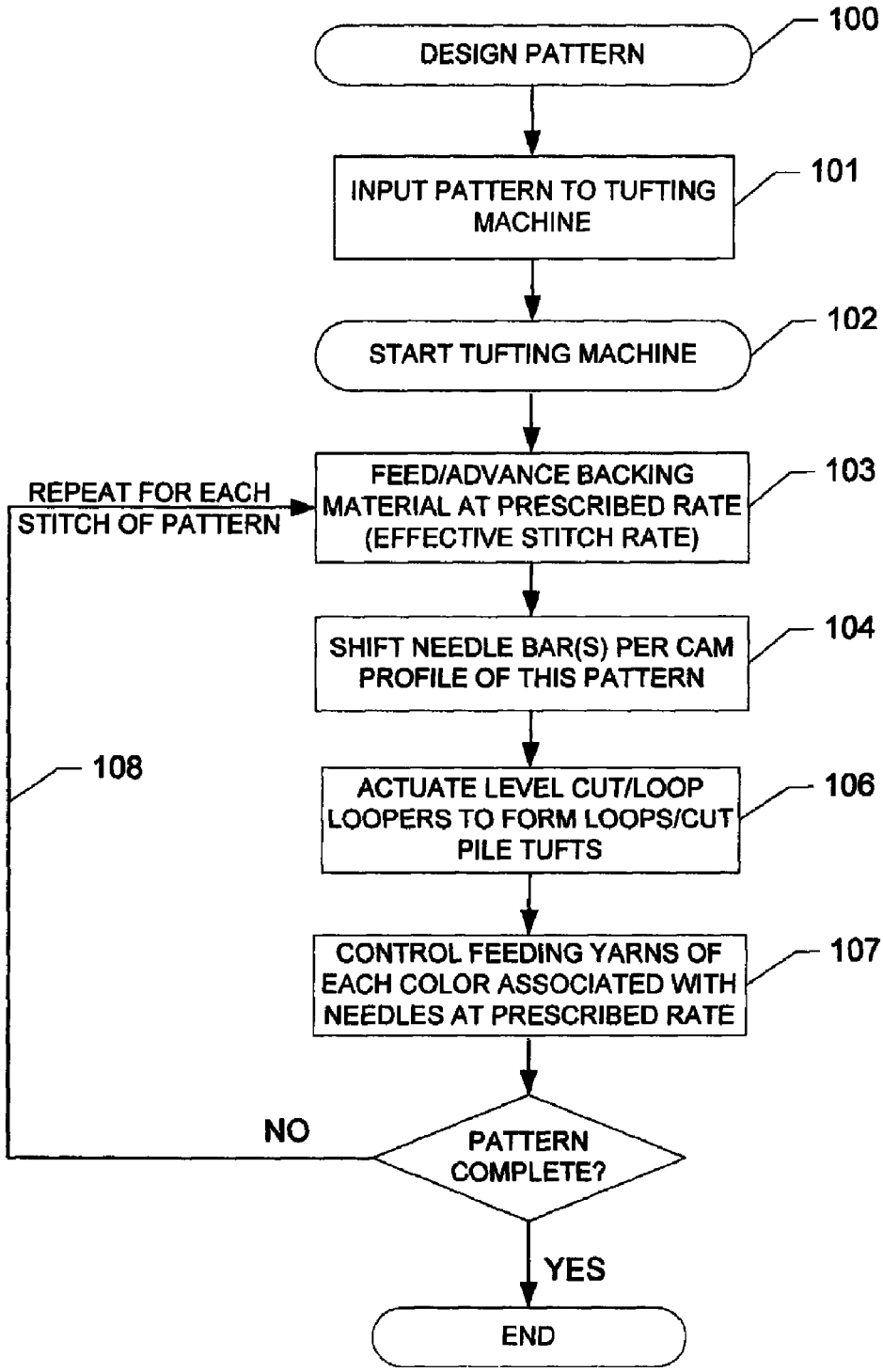
FIG. 7 is a flow diagram illustrating the operation of the yarn color placement system according to the present invention.

FIG. 7 generally illustrates one embodiment of the operation of the yarn color placement system according to the principles of the present invention. As an initial step 100, the pattern generally will be designed, such as at a design center, with various parameters, such as the number of colors, desired stitch rate, and shifts or jumps of the pattern generally inputted or calculated to create the desired pattern, including the use of a variety of different colored yarns. Thereafter, as indicated at step 101, the pattern will be transferred to the tufting machine 10 (FIG. 1) generally by being loaded into the system control 25 for the tufting machine by disk or network connection to the design center. Once the desired pattern(s) has been loaded, the tufting machine will be started, as indicated at 102 (FIG. 7), to start the tufting operation.

As the pattern is sewn, the backing material B (FIG. 2) is fed through the tufting zone T at the effective stitch rate, as indicated in block 103 (FIG. 7). As discussed above, this effective stitch rate is substantially different from conventional stitch rates (i.e., by a factor approximately equivalent to the number of colors being tufted) in order to provide sufficient density for the tufts being formed in the pattern fields to hide those color yarns not to be shown. As indicated at step 104, as the pattern is formed in the backing material, the needle bars are generally shifted per the cam profile or shift profile of the pattern. For example, as indicated in FIGS. 6A-6D, the needle bar will be shifted using a combination of single and/or double jumps or shifts, based on the number of colors being run in the pattern and the area of the pattern field being formed by each specific color, and with the initial (first) and last steps shown as repeating, wherein the last stitch shown typically is the first stitch of the next pattern/shift profile repeat. Such a combination of single and double shift jumps or steps will be utilized in order to avoid over-tufting or engaging previously sewn tufts as the needle bar is shifted transversely and the backing material advances at its effective or operative stitch rate. Additionally, as the needles penetrate the backing material, the gauge parts (FIG. 2) of the looper/hook assembly 32 positioned below the tufting zone T, also are reciprocated toward the tufting zone so as to engage and pick or pull loops of yarns from each of the needles.

As indicated in FIG. 7 at step 106, as the level cut loop loopers are being moved into engagement with the needles, they are selectively actuated, as needed to form loops of yarns, that either will be released from the level cut loop loopers, or retained thereon for forming cut pile tufts. The level cut loop loopers each will be individually controlled by the control system 25 (FIG. 1) of the tufting machine so as to be selectively fired, as needed, according to the movement of the stepping or shifting needle bar. As a result, for each step or shift of the needle bar according to the pattern, each level cut looper actuator will be controlled individually so as to selectively engage or retract its clip to enable selected loops of yarns to be picked from the needles by the level cut loop loopers and held for cutting, thus forming cut pile tufts. In their extended positions, the clips will cause the loops of yarns engaged by the level cut loop loopers to be released to form either loop pile tufts, or which will be pulled low or back-robbed by operation of the pattern yarn feed attachment controlling the feeding of such yarns, to hide or bury the non-selected ends of these yarns within a particular color field being formed according to the pattern instructions.

As the needles are retracted from the backing material during their reciprocal movement in the direction of arrow 37' (FIG. 2), the feeding of the yarns by the pattern yarn feed attachments or yarn feed mechanisms 27/28 (FIG. 1) also will be controlled as indicated at step 107 (FIG. 7) in conjunction with the shifting of the needles to selectively form high tufts of yarns at selected locations in each pattern field, as well as to form the low tufts of yarns. The feeding of the yarns of the non-selected colors (the colors that are to be hidden and thus not visible in the particular color fields of the pattern being sewn at that step) will be controlled by the yarn feed mechanisms feeding each of these yarns so that these yarns will be back-robbed or pulled low, or even pulled out of the backing material so as to "float" on the back of the backing material, to form the low tufts. As a further result, the number of high tufts (the colors that are visible in the finished tufted article), generally can be matched to the desired stitch rate for the tufting machine, i.e., 10 high stitches per inch for a tenth gauge machine, etc. The running of the enhanced, effective stitch rate being run by the yarn color placement system of the present invention in conjunction with the shift profile helps provide for a denser field of stitches or tufts, with the yarns being pulled low or backrobbed thus being effectively hidden by the remaining (high) cut and/or loop pile tufts formed in the backing material.

The control of the yarn feed by the yarn feed pattern attachments for the control of the feeding of yarns of a variety of different colors, in conjunction with the operation of each shift mechanism and level cut loop loopers or hooks and/or cut pile hooks and loop pile hooks, together with the backing material being run at an effective or operative stitch rate that is substantially increased or denser than stitch rates solely based upon gauge of the machine, accordingly enables the yarn color placement system of the present invention to produce a greater variety of free-flowing patterns and/or patterns with a loom-formed appearance to be formed in the backing material. Such patterns further typically can have a substantially even or equivalent number of high tufts being formed in each linear/longitudinal tuft row of the resultant patterned tufted article to provide a desired or sufficient pattern density wherein each color can be placed at a desired location or point along the backing material. As indicated at step 108 in FIG. 7, the operation of the yarn color placement system continues, and is repeated for each stitch of the pattern until the pattern is complete.

It will be understood by those skilled in the art that while the present invention has been discussed above with reference to particular embodiments, various modifications, additions and changes can be made to the present invention without departing from the spirit and scope of the present invention.

What is claimed:

1. A method of tufting patterned articles including tufts of multiple different color yarns, comprising:

feeding a backing material through a tufting machine at a prescribed stitch rate for the patterned tufted article;

as the backing material is fed through the tufting machine, reciprocating a series of needles to deliver the yarns into the backing material;

engaging the yarns delivered into the backing material by the needles with a series of gauge parts to pull loops of yarns from the needles for forming tufts of yarns in the backing material;

shifting at least some of the needles transversely according to a shift profile of a pattern for the article;

selectively controlling feeding of the yarns to the needles in accordance with the shift profile of the pattern for the article to form high tufts of yarns and to pull back loops of yarns as desired;

wherein the tufts of yarns are formed in the backing material at an increased effective process stitch rate that is substantially equivalent to the prescribed stitch rate times the number of different colors formed in the pattern.

2. The method of claim 1 and wherein controlling feeding of the yarns comprises back-robbing yarns to form low tufts to be hidden among the high tufts in the patterned articles.

3. The method of claim 1 and wherein controlling feeding of the yarns comprises controlling each yarn fed to each needle to selectively form high tufts of yarns and to pull selected yarns low or out of the backing material.

4. The method of claim 1 and wherein at least two different colors of yarns are used in the pattern and the effective process stitch rate is at least approximately two times the prescribed stitch rate for the patterned article for the feeding of the backing material.

5. The method of claim 1 and further comprising forming a number of high tufts in each tuft row that is approximately equivalent to the prescribed stitch rate.

6. The method of claim 1 and further comprising forming an approximately equivalent number of high tufts in each tuft row for each color-step of the pattern.

7. The method of claim 1 and further comprising selectively forming cut and loop pile tufts.

8. A method of operating a tufting machine to form patterned tufted articles having multiple colors, comprising:

feeding a backing material through the tufting machine;

feeding a plurality of yarns to a series of needles carried by a shiftable needle bar;

shifting the needle bar transversely according to a programmed shift profile for the pattern of the tufted article;

controlling the feeding of the yarns to the needles in accordance with programmed pattern instructions so as to feed desired amounts of the yarns to the needles as needed to form rows of high and low tufts of yarns in the backing material;

forming the tufts of yarns at an increased effective stitch rate determined by multiplying the number of colors being formed in the patterned tufted article by a desired fabric stitch rate that comprises a number of stitches per inch desired for the patterned tufted articles; and wherein the feeding of the yarns to form the high and low tufts tracks the shifting of the needles so as to substantially maintain density of the tufts of yarns being formed in the backing material in a direction of the rows of tufts and location of the high tufts of yarns at desired positions across the backing to form the patterned tufted articles.

9. The method of claim 8 and wherein controlling the feeding of the yarns comprises feeding a first amount of yarn to each needle forming a high tuft, while feeding a second, lesser amount of yarn to each needle forming a low tuft.

10. The method of claim 9 and wherein feeding a second, lesser amount of yarn comprises back-robbing the yarns fed to each needle to an extent sufficient to substantially hide or remove the low tufts from the backing.

11. The method of claim 8 and further comprising forming a number of high tufts in the backing that approximately matches the desired stitch rate.

12. The method of claim 8 and wherein the tufting machine is a $1/10^{th}$ gauge tufting machine and the desired fabric stitch rate is approximately ten stitches per inch.

13. The method of claim 12 and wherein the patterned tufted article includes at least two colors, and wherein the effective process stitch rate about twenty stitches per inch.

14. The method of claim 8 and wherein the tufting machine is a $1/8^{th}$ gauge tufting machine and the desired fabric stitch rate is approximately eight stitches per inch.

15. The method of claim 14 and wherein the patterned tufted article includes at least two colors, and wherein the effective process stitch rate is at least about sixteen stitches per inch.

16. The method of claim 8 and wherein the tufting machine is a $1/16^{th}$ gauge tufting machine and the desired fabric stitch rate is approximately sixteen stitches per inch.

17. The method of claim 16 and wherein the patterned tufted article includes at least two colors, and wherein the effective process stitch rate is at least about thirty-two stitches per inch.

18. The method of claim 8 and further comprising repeating an initial shift step in the programmed shift profile of the pattern.

19. The method of claim 8 and further comprising selectively actuating a series of clips of level cut loop loopers for each stitch of the pattern to form cut pile and loop pile tufts.

* * * * *